US005183295A

United States Patent [19]

Barnette

[11] Patent Number: 5,183,295

[45] Date of Patent: Feb. 2, 1993

[54] DUST COVER LAMINATE FOR BOOKS

[75] Inventor: Charles J. Barnette, Akron, Ohio

[73] Assignee: Kent Adhesive Products, Inc., Kent, Ohio

[21] Appl. No.: 749,861

[22] Filed: Aug. 26, 1991

[51] Int. Cl.[5] ..... B42D 3/00; B42D 3/02

[52] U.S. Cl. ..... 281/29; 281/34; 281/15.1; 281/21.1; 156/227

[58] Field of Search ..... 281/29, 34, 15.1, 21.1; 428/40; 156/226, 227, 247, 249, 289

[56] References Cited

U.S. PATENT DOCUMENTS

| | | | |
|---|---|---|---|
| 3,891,240 | 6/1975 | Du Corday | 281/29 |
| 4,744,592 | 5/1988 | Barnette et al. | 281/29 X |
| 4,893,979 | 1/1990 | Alpers | 281/29 X |
| 4,941,791 | 7/1990 | Iwamoto | 281/29 X |
| 5,004,514 | 4/1991 | Pugliese et al. | 281/29 X |
| 5,029,900 | 7/1991 | Axelrod | 281/29 X |

*Primary Examiner*—Paul A. Bell

*Attorney, Agent, or Firm*—Renner, Kenner, Greive, Bobak, Taylor & Weber

[57] ABSTRACT

A pair of laminates for a dust cover for a hardback book assures that the dust cover is protected from damage while also providing a means for adhesively securing the dust cover to the book. A polyester sheet is adhesively laminated to the outer surface of the dust cover. In like manner, a double backed adhesive sheet is laminated to the undersurface or back side of the dust cover. The double backed tape then provides a means for adhesively securing the dust cover to the front and back hard cover of the book and around the side edges thereof, and in which the ends of the dust cover laminate are adhered to the undersurface of the front and back hard covers of the book.

4 Claims, 2 Drawing Sheets

DUST COVER LAMINATE FOR BOOKS

TECHNICAL FIELD

The invention herein resides in the art of protective devices and, more particularly, to a laminate for protecting the dust cover of a hardback book, while securedly binding such dust cover to the book.

BACKGROUND ART

It is presently known that many hardback books are originally sold with a paper dust cover. This dust cover is often provided with illustrations, graphics, or other art work which is not otherwise present on the hard cover of the book itself. Additionally, the dust cover is typically of brighter colors and of a more attractive nature than the hard cover. Accordingly, it is most desirable that the dust cover be kept clean, undamaged, and unmarred in use.

In the past, it has typically been known that, over a course of time, the dust cover may become so damaged or soiled that it is no longer attractive, but is simply removed from the book and discarded. It has been found that a substantial portion of the damage which occurs in such dust covers is a result of the fact that the dust covers slide upon or are removable from the books themselves. The loose nature of the dust cover makes its susceptible to ripping, tearing, and other damage.

There is a need in the art for a means for applying a protective laminate over the dust cover itself and to bind or otherwise securedly adhere the dust cover to the hard book cover.

DISCLOSURE OF INVENTION

In light of the foregoing, it is a first aspect of the invention to provide a dust cover laminate for books which provides a protective coating over the dust cover itself.

Another aspect of the invention is the provision of a dust cover laminate for books which provides a means for securedly adhering the dust cover to the hard cover of the book.

Yet another aspect of the invention is the provision of a dust cover laminate for books which is simple to manufacture and use, and is reliable and durable in achieving its intended purpose.

Still a further aspect of the invention is the provision of a dust cover laminate for books which is inexpensive to manufacture and cost effective in implementation.

The foregoing and other aspects of the invention which will become apparent as the detailed description proceeds are achieved by a system for protecting and affixing a dust cover to a book, comprising: a top laminate adapted to be applied over a top surface of the dust cover; and a bottom laminate adapted to be applied over a bottom surface of the dust cover.

Other aspects of the invention are attained by a method of protecting and affixing a dust cover to a book, comprising: adhering a transparent protective film to a front surface of the dust cover; covering a back surface of the dust cover with an adhesive coating; and bonding said back surface of the dust cover to a hard cover of the book with said adhesive coating.

DESCRIPTION OF DRAWINGS

For a complete understanding of the objects, techniques and structure of the invention reference should be made to the following detailed description and accompanying drawings wherein.

It will be appreciated that the various cross sectional views of the drawings are for illustrative purposes and are not necessarily to scale.

BEST MODE FOR CARRYING OUT THE INVENTION

Figure 1:
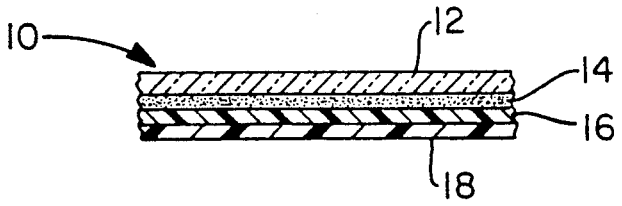
FIG. 1 is a cross sectional view of a top laminate used for covering a dust cover according to the invention.

Referring now to the drawings and more particularly FIG. 1, it can be seen that a top laminate according to the invention is designated generally by the numeral 10. As shown, the laminate 10 includes a transparent polyester sheet or film 12 having a thickness of 0.5–5 mils, and bearing a layer of pressure sensitive adhesive 14 on a side thereof. An appropriate release coating 16, such as a silicone coating, is provided upon a backing sheet 18 which is adhered to the adhesive layer 14 until its removal for use. Those skilled in the art will readily recognize that the release coating 16 upon the backing sheet 18 accommodates the release of the backing sheet 18 from the adhesive layer 14 when desired.

Figure 2:
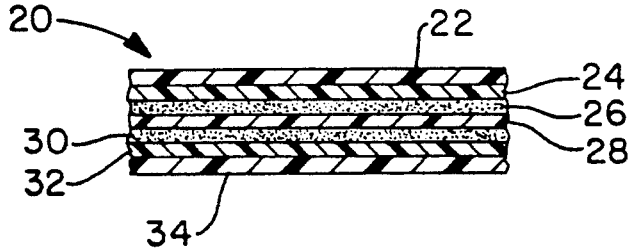
FIG. 2 is cross sectional view of a bottom laminate used for covering a bottom portion of the dust cover according to the invention.

As shown in FIG. 2, a bottom laminate according to the invention is designated generally by the numeral 20. Here, a backing sheet 22 has a release layer or coating 24 thereon. The release layer 24 is in contacting engagement with a layer of pressure sensitive adhesive 26 which is carried upon a suitable carrier member 28 such as a thin polyester layer or the like. On the opposite side of the carrier 28 is another layer of pressure sensitive adhesive 30 which is in contact with the release layer 32 of the backing sheet 34. Those skilled in the art will readily recognize that the laminate 20 effectively comprises a double backed adhesive sheet having appropriate backing sheets in contacting engagement through respective release layers with each of the adhesive layers.

Figure 3:
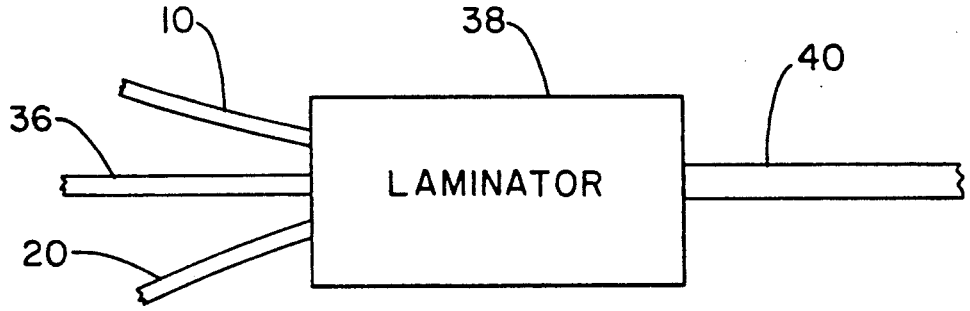
FIG. 3 is an illustrative schematic view of a laminator employed for applying the laminates of FIGS. 1 and 2 to their respective sides of a book dust cover.

According to the invention, a portion of the laminate 10 of FIG. 1 is employed to cover and protect the outer surface of a dust cover for a hardback book, while the double backed adhesive laminate 20 is applied to the inner or under surface of the dust cover to achieve total securement of the dust cover with the hard cover of the book. Accordingly, it is necessary that the laminates 10 and 20 be applied to the respective surfaces of the dust cover and, to that end, the technique and apparatus of FIG. 3 is employed. As shown, the dust cover 36 which has been removed from a hardcover book is introduced to a suitable laminator 38 to which it is also submitted the top laminate 10 and the bottom laminate 20. The laminator 38 removes the backing sheet 18 via the release coating 16 and applies the polyester sheet 12 to the top surface of the dust cover 36 by means of the adhesive layer 14. In like manner, the laminator 38 strips or removes the backing sheet 22 and the release layer 24 from the layer 26 of pressure sensitive adhesive. The pressure sensitive adhesive layer 26 is then applied to the bottom surface of the dust cover 36 so that the dust cover laminate 10 is produced. It will be appreciated that the laminating process just described can be performed manually as well as with the laminator 38.

Figure 4:
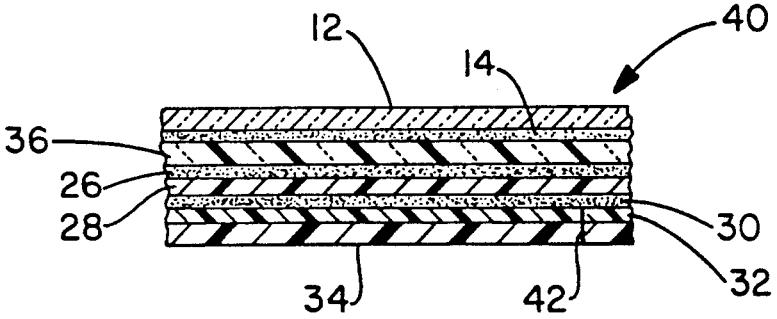
FIG. 4 is a cross sectional view of the laminate achieved according to the apparatus and technique of FIG. 3.

A cross sectional view of the laminate 40 is shown in FIG. 4, where it can be seen that the dust cover 36 has a protective polyester sheet 12 adhesively applied to the top surface thereof, and a double backed adhesive tape 26, 28, 30 attached to the bottom surface thereof and covered by the backing sheet 34 by means of the release layer 32. As shown, a slit or score line 42 is transversely provided within the backing sheet 34 for ease of removal of the backing sheet 34 in a manner to be discussed below.

Figure 5:
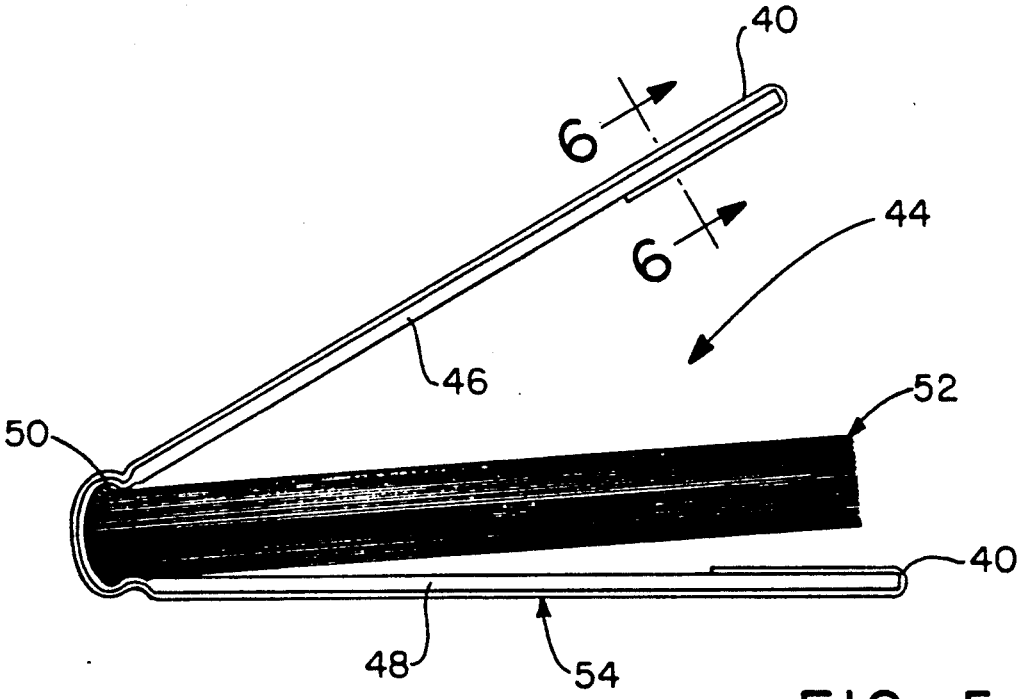
FIG. 5 is an end view of a book having a dust cover thereon of the type shown and described in FIG. 4.
Figure 6:
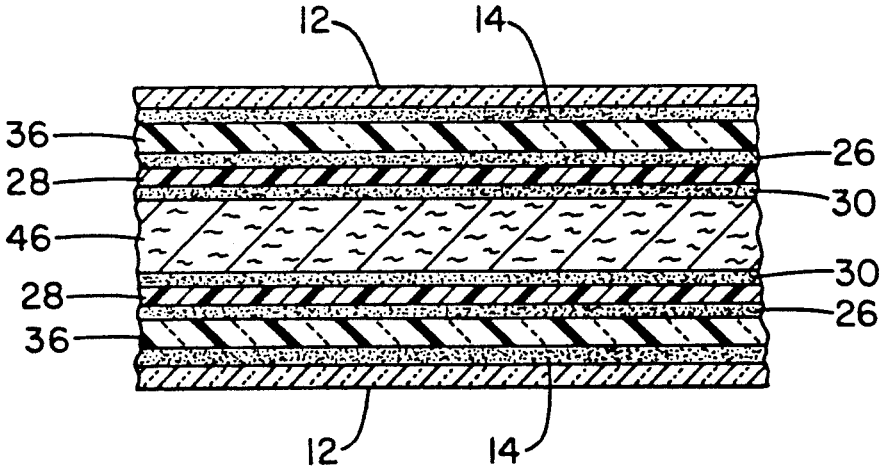
FIG. 6 is a cross sectional view of the cover of the book of FIG. 5 taken along the lines 6—6.

With reference now to FIG. 5, an appreciation of the implementation of the dust cover laminate 40 can be obtained. As shown, a hardback book 44 is provided with a hard cover flap 46 and a hard back flap 48 which cover the binding 50 of the pages 52 at the spine of the book. Typically, the book 44 will be covered with a decorative paper dust cover. According to the invention, the dust cover 36 is removed from the book 44 and passed through the laminator 38 of FIG. 3 as discussed above to achieve the laminate 40 shown in FIG. 4. A small strip of backing sheet 34 and associated release layer 32 is removed from the adhesive layer 30 by means of the slit or score line 42. Accordingly, a small strip of pressure sensitive adhesive 30 is exposed at an end of the laminate 40. With the laminate 40 positioned over the front cover or flap 46 of the book 44 to be in proper alignment therewith, the exposed pressure sensitive adhesive is tacked to an inner surface of the front cover flap 46 along the entire height of the cover 46. At this point in time, the laminate 40 is fixed in proper registration with the covers 46, 48 of the book 44. The remainder of the backing strip 34 and release layer 32 is slowly removed from the adhesive layer 30, commencing at the line originally defined by the split 42, and the adhesive is brought into contacting and adhering engagement with the cover 46. The laminate 40 is "walked" around the edge of the cover 46 and is smoothed out with a "squeegee" or the like over the outer surface of the flap 46, around the binding 50, over the outer surface of the back cover or flap 42, and wrapped around the edge of such flap and into sealing contacting engagement with the inner surface of the book flap 48. For ease of handling, the backing strip 34 is removed slightly ahead of the area of the laminate 40 being "worked" onto the book cover. As a result, the book 44 is provided with a dust cover 54 which is adhesively attached over the totality of the book cover and upon the inner surfaces of the cover flaps thereof, and in which the dust cover has a protective polyester sheet over the totality thereof.

Those skilled in the art can readily appreciate that the laminates 10, 20 may be sized to be congruent with the dust cover 36 prior to introduction into the laminator 38, or may be oversized with respect to such dust cover, such that the resulting laminate 40 need only be trimmed with appropriate cutting implements. Those skilled in the art will further appreciate that the pressure sensitive adhesive used should be non-acidic, so as not to yellow. Additionally, the polyester sheet 12 may, if desired, be provided with a suitable type of ultraviolet filtering to prevent yellowing and/or discoloration of the dust cover 36.

It should now be apparent that laminates for a book dust cover have been provided to both protect the dust cover and to assure its total adhesion to the book cover. The flexible nature of the polyester sheet 12 and the double back adhesive 26, 28, 30 assures that the laminate will flex at the bindings as the covers are opened and closed and will not crack, deteriorate, or otherwise detract from the appearance of the book. There is no longer a chance for the book to slide out of its jacket or dust cover, nor is it likely that the cover will snag or hook on objects and tear, rip, or otherwise become marred or unattractive.

Thus it can be seen that the objects of the invention have been satisfied by the structure presented above. While in accordance with the patent statutes only the best mode and preferred embodiment of the invention has been presented and described in detail, it is to be understood that the invention is not limited thereto or thereby. Accordingly, for an appreciation of the true scope and breadth of the invention reference should be made to the following claims.

What is claimed is:

1. A method of protecting and affixing a dust cover to a book, comprising;

adhering a transparent protective film to a front surface of the dust cover with a pressure sensitive adhesive;

covering a back surface of the dust cover with a double backed adhesive laminate, thereby providing an adhesive coating on said back surface; and bonding said back surface of the dust cover to a hard cover of the book with said adhesive coating.

2. The method according to claim 1, wherein said step of bonding said dust cover to said hard cover commences with a first end of the dust cover being attached to an inside surface of a first flap of the hard cover.

3. The method according to claim 2, wherein said bonding of said dust cover to said hard cover continues from said first end to a distant second end and wherein said second end is attached to an inside surface of a second flap of the hard cover.

4. The method according to claim 3, wherein said dust cover is completely bonded to said hard cover over the totality of said back surface of said dust cover.

* * * * *